US007160120B2

(12) United States Patent
Zhang et al.

(10) Patent No.: US 7,160,120 B2
(45) Date of Patent: Jan. 9, 2007

(54) ELECTRICAL CONNECTOR HAVING STRENGTHENED MEMBERS

(75) Inventors: Zhi-Qiang Zhang, Kunsan (CN); Ning Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/159,981

(22) Filed: Jun. 22, 2005

(65) Prior Publication Data

US 2006/0105630 A1 May 18, 2006

(30) Foreign Application Priority Data

Nov. 18, 2004 (CN) ..... 2004 2 109015

(51) Int. Cl.
*H01R 12/00* (2006.01)

(52) U.S. Cl. ..... 439/79; 439/660

(58) Field of Classification Search ..... 439/79, 439/80, 607, 608, 660
See application file for complete search history.

(56) References Cited

U.S. PATENT DOCUMENTS

| | | | | |
|---|---|---|---|---|
| 6,309,255 | B1 * | 10/2001 | Yu | 439/660 |
| 6,371,809 | B1 * | 4/2002 | Chun-Yuan | 439/607 |
| 6,435,912 | B1 * | 8/2002 | Zhu et al. | 439/607 |
| 6,652,317 | B1 * | 11/2003 | Shao | 439/607 |
| 6,945,824 | B1 * | 9/2005 | Li et al. | 439/660 |
| 6,955,568 | B1 * | 10/2005 | Wu | 439/660 |
| 6,986,681 | B1 * | 1/2006 | Tsai | 439/607 |

* cited by examiner

*Primary Examiner*—Thanh-Tam Le
(74) *Attorney, Agent, or Firm*—Wei Te Chung

(57) ABSTRACT

An electrical connector includes an insulative housing (1), a plurality of terminals (2) retained in the insulative housing, a shell (3) and a pair of strengthened members (4). The insulative housing comprises a base portion (10) and a terminal supporting portion (12) extending forwardly from the base portion. Each terminal has a contact portion (20) extending along the terminal supporting portion. The shell is attached to the insulative housing and has a mating frame (31) surrounding the contact portions and the terminal supporting portion to define a mating cavity therebetween. Strengthened members are buried at opposite ends of the terminal supporting portion.

15 Claims, 4 Drawing Sheets

ELECTRICAL CONNECTOR HAVING STRENGTHENED MEMBERS

BACKGROUD OF THE INVENTION

1. Field of the Invention

The present invention generally relates to an electrical connector, and particularly relates to an electrical connector having strengthened members for strengthening the intensity of the insulative housing.

2. Description of Related Arts

Due to the booming development of the electronic industry, electro-consumer products become more and more popular. Miniaturization, integration and multi-function have been the inevitable trends what those products develop to. It also desires more power signals to be given to the electrical equipments, in respect that the integrated circuits have more applications, and the densities of the electrical components connected to the integrated circuits become much higher. To obtain more input power, power connectors of the electro-consumer products often need more conductors. U.S. Pat. No. 5,158,471 discloses a power connector having many contacts, which are densely arranged in an insulative housing. However, a bare periphery of those contacts makes them vulnerable, then have poor orientation ability. Therefore, when a complementary connector is inserted into the power connector, nevertheless the insertion direction has just a little deflection, those non-protective contacts would be forced and tend to warp even breaking off, which may result in signals shut off.

U.S. Pat. No. 6,482,045 discloses an improved electrical connector. It has an insulator body with a planar plate-like contact support protruding forwardly. At the front end of the contact support forms outer protrusions, against which front ends of contacts of a complementary connector abut. While insertion of the complementary connector, this connector could avoid damages of contacts resulting from deflected insertion of the complementary connector, because the mating contacts touch upper and lower sides of outer protrusions firstly, which weakens the forces greatly. However, this structure complexes the manufacture of the housing, and does not follow the miniaturization trend of products.

Hence, it is desirable to have an improved electrical connector to overcome the above-mentioned disadvantages of the related art.

SUMMARY OF THE INVENTION

It is an object of the present invention to provide an electrical connector having strengthened members for strengthening the intensity of the insulative housing, and with smaller size and more convenient manufacture of the electrical connector.

In order to achieve the above-mentioned object, an electrical connector includes an insulative housing, a plurality of contacts or terminals retained in the insulative housing, a shell and a pair of strengthened members. The insulative housing comprises a base portion with a plurality of passageways extending therethrough, and a contact or terminal supporting portion extending forwardly from the base portion. The passageways divide the contact or terminal supporting portion into several parts or ribs, the plurality of contacts or terminals are received in the passageways. Each contact or terminal has a contact portion extending along the contact or terminal supporting portion. The shell is attached to the insulative housing and has a mating frame surrounding the contact portions and the contact or terminal supporting portion to define a mating cavity therebetween. Strengthened members are buried at opposite ends of the contact or terminal supporting portion. It could enhance the intensity of the insulative housing and improve the ability of enduring the deflected insertion of a complementary connector.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
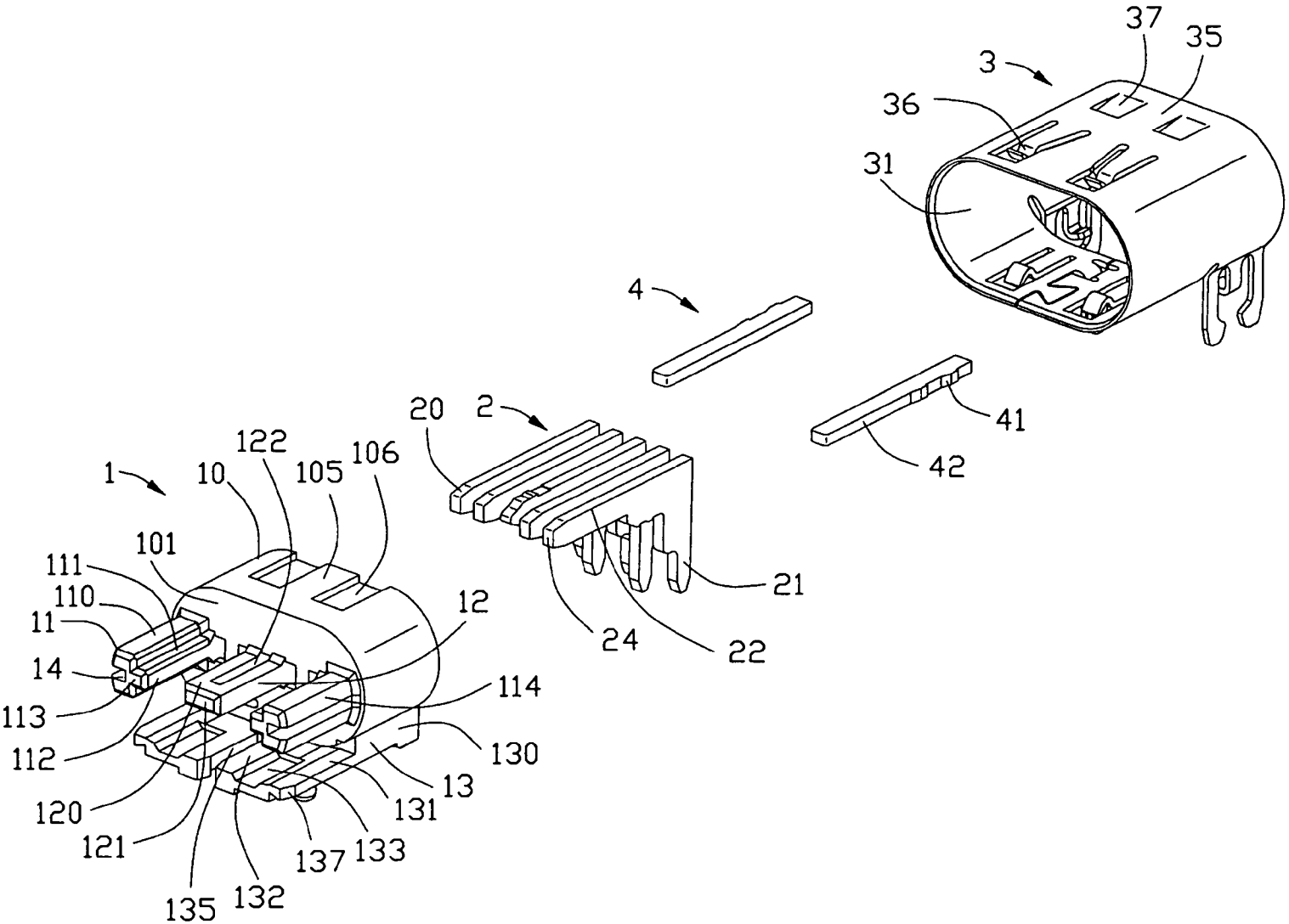
FIG. 1 is an exploded, perspective view of an electrical connector in accordance with the present invention.

Reference will now be made to the drawing figures to describe the present invention in detail.

Figure 2:
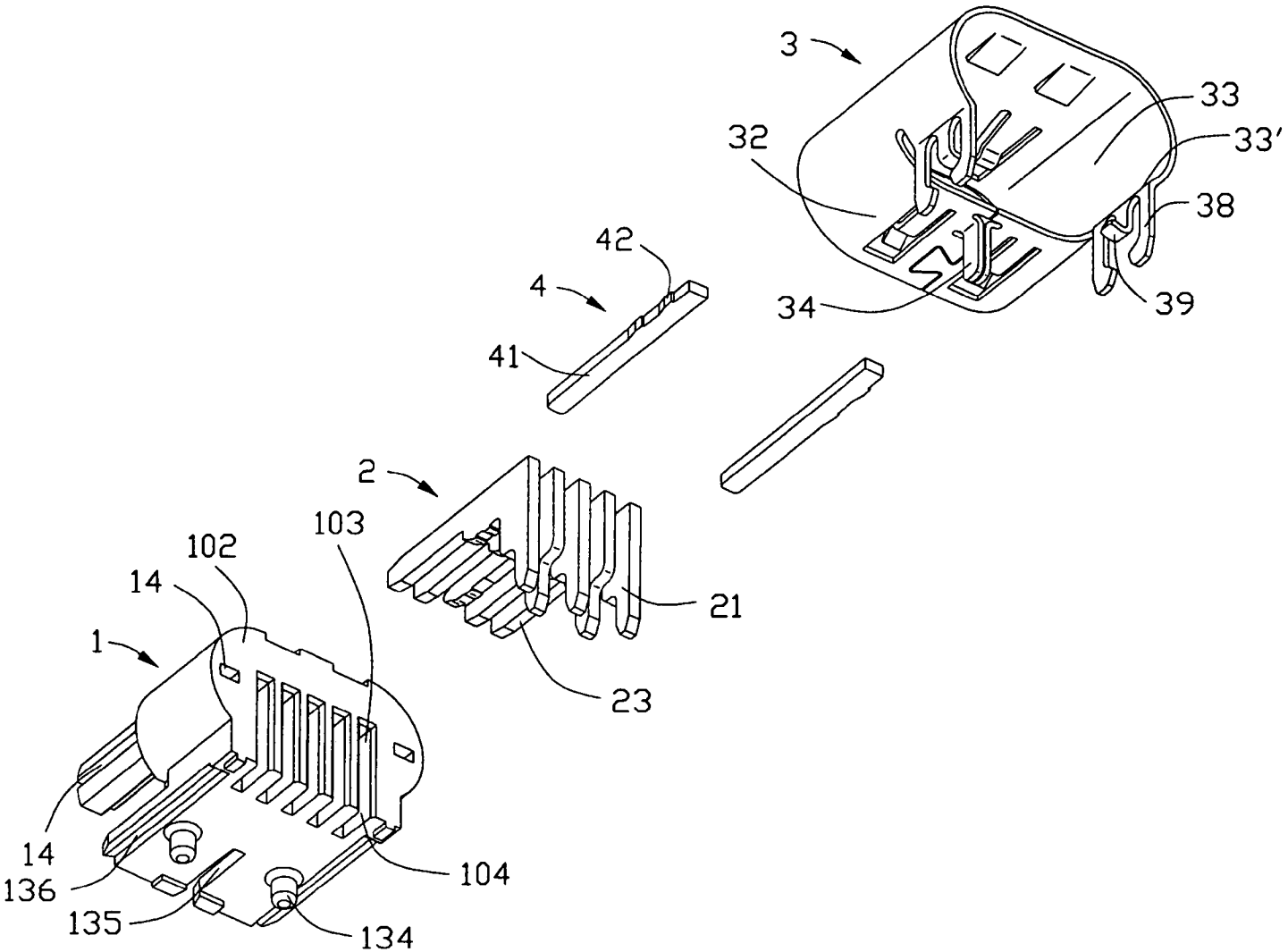
FIG. 2 is a view similar to FIG. 1, but taken from a different perspective.

Referring to FIGS. 1–2, an electrical connector in accordance with the present invention comprises an insulative housing 1, a plurality of contacts or terminals 2 received in corresponding passageways of the insulative housing 1, a shell 3 surrounding the insulative housing 1 and a pair of strengthened members 4.

Taking reference to FIGS. 1–2, the insulative housing 1 has a base portion 10 with an approximately elliptic cross-section. The base portion 10 defines an upper face 105, a front face 101 and an opposite back face 102. A plurality of passageways 103 extend through the base portion 10 in a front-to-back direction. Several vertical slots 104 are defined by concaved into lower part of the back face 102, and are in communication with corresponding passageways 103 respectively. The base portion 10 defines two cutouts 106 on the upper face 105 thereof A tongue portion 12 is formed by extending forwardly from substantialy the middle of the base portion 10. The tongue portion 12 comprises a pair of level surfaces 120. Passageways 103 further extend onward to divide the tongue portion 12 into several parts or ribs, and these parts or ribs lie parallel with each other in a mating direction of a complementary connector (not shown). These parts or ribs could be individual with the others, or link with neighboring one at distal ends, even could be cut off absolutely from the base portion 10. In this embodiment, two middle parts or ribs of the tongue portion 12 are linked by a beam 121 at distal ends with an inside elongated through-hole 122 defined therebetween. The through-hole 122 is in communication with the middle passageway 103.

The tongue portion 12 forms two side ribs 11 at two longitudinal ends thereof respectively. There are also two parts or ribs respectively between the two side ones 11 and the two middle ones been cut off from the base portion 10 to define an empty space between each side rib 11 and a corresponding adjacent middle rib. The side ribs 11 are also adjacent to the opening (not labeled) of two side passageways 103. Each side rib 11 has two surfaces 111 at opposite level sides. Referring to FIG. 1 in detail, each side rib 11 has two protrusions 110 respectively projecting beyond the surfaces 111 along a vertical direction. Each side rib 11 comprises a vertical inside surface 112 and an outside surface 114. The outside surface 114 is a little arc-shaped. The distal ends of each side rib 11 are an integrated planar surface called outer surface 113. Each side rib 11 defines a channel 14 inside thereof. The channels 14 is about rectangular-shaped and extend backward to run through the back face 102 of the base portion 10.

A mounting portion 13 is provided lower than the base portion 10, with a vertical portion 130 interconnecting a rear of the mounting portion 13 and a lower face (not labeled) of the base portion 10. The vertical slots 104 also extend through the vertical portion 130 and the mounting portion 13 to be exposed out of its bottom face (not labeled). A channel 135 is defined in a middle of a front of the mounting portion 13 along a front-to-back direction to divide the mounting portion 13 into two guiding portions 137. An upper face of each guiding portion 137 respectively defines a depression portion 133 thereon. Two latching grooves 136 are defined on the edges of the bottom face of the mounting portion 13 respectively. A pair of column form positioning posts 134 extend downwardly from the bottom face of the mounting portion 13.

Referring to FIGS. 1–2, each contact or terminal 2 comprises a mating portion 20 extending forwardly for engaging with a contact of the complementary connector, and a vertical connecting portion 21 for connecting to a printed circuit board (PCB). Each horizontal mating portion 20 includes a first conductive surface 22, a second conductive surface 23 and an end surface 24. The first and second conductive surfaces 22, 23 of each contact or terminal 20 are opposite to each other.

The two high-intensity components 4 are substantially rectangular-shaped and none of them used to transfer electrical date or digital signals. Each comprises a retaining portion 41 and a strengthening portion 42. The high-intensity components 4 can be made by metal or other hard polymers.

The electrical connector of present invention also includes a shell 3 with an approximately elliptic cross-section. A mating frame 31 is defined inside the shell 30 with an upper wall 35 and a lower wall 32 opposite to each other. A rear of the lower wall 32 defines a rectangular gap 33, the two sides 33' of which respectively extends two pairs of plate-like mounting legs 38 vertically and a pair of latching legs 39 curved at their ends. A plate-like positioning leg 34 is provided apart from a front of the rectangular gap 33. Each upper and lower walls 35 and 32 form a pair of curved beams 36 extending forwardly with the distal ends bent inwardly into the receiving space 31 for retaining the complementary connector. A rear of the upper wall 35 forms two spring tabs 37 extending downwardly and defectively into the receiving space 31.

Referring to FIGS. 1–4, in assembly, the horizontal mating portion 20 of each terminal 2 is inserted into corresponding passageway 103 of the base portion 10 from its rear into the tongue portion 12. The connecting portion 21 of each terminal 2 is received in corresponding vertical slot 104 and extends out of the bottom face of the mounting portion 13. The part of tongue portion 12 between each side terminal and its neighboring one is cut-off. Each strengthened member 4 is inserted to the channel 14 from the back face 102 of the base portion 10, with its retaining portion 41 retained in the base portion 10 and the strengthening portion 42 surrounded by the side rib 11. Thus, the strengthened members 4 can enhance the intensity of the side ribs 11. Because side ribs 11 extend forwardly adjacent to the opening of the two side passageways 103 from the front face 101 of the base portion 10, each of the two outer terminals 2 lies with corresponding side rib 11 side by side. More specifically, a side surface (not labeled) of each outer terminal 2 touches with the inside surface 112 of corresponding side rib 11. When contacts of complementary connector are deflected inserted, the protrusions 111 can abut against the connectors and min possible broken of the terminals 2. When abrupt forces are applied to the terminals 2, the strengthened members 4 can help endure the impacts and reduce the possibility of broken of the side ribs 11. In this way, this electrical connector does well in preventing deflected insertion of the complementary connector. The two outer surfaces 113 of the ribs 11 protrude beyond the end surfaces 24 of the terminals 2, in other word, the ribs 11 extend further than the terminals 2 in a direction away from the base portion. The first and second conductive surfaces 22, 23 of the middle terminals 2 respectively protrude a little distance beyond the corresponding level surfaces 120, to contact the terminals of the complementary connector. The mating portions 20 of the terminals 2, the tongue portion 12 and the side ribs 11 extend the same direction, and are parallel with each other.

Figure 3:
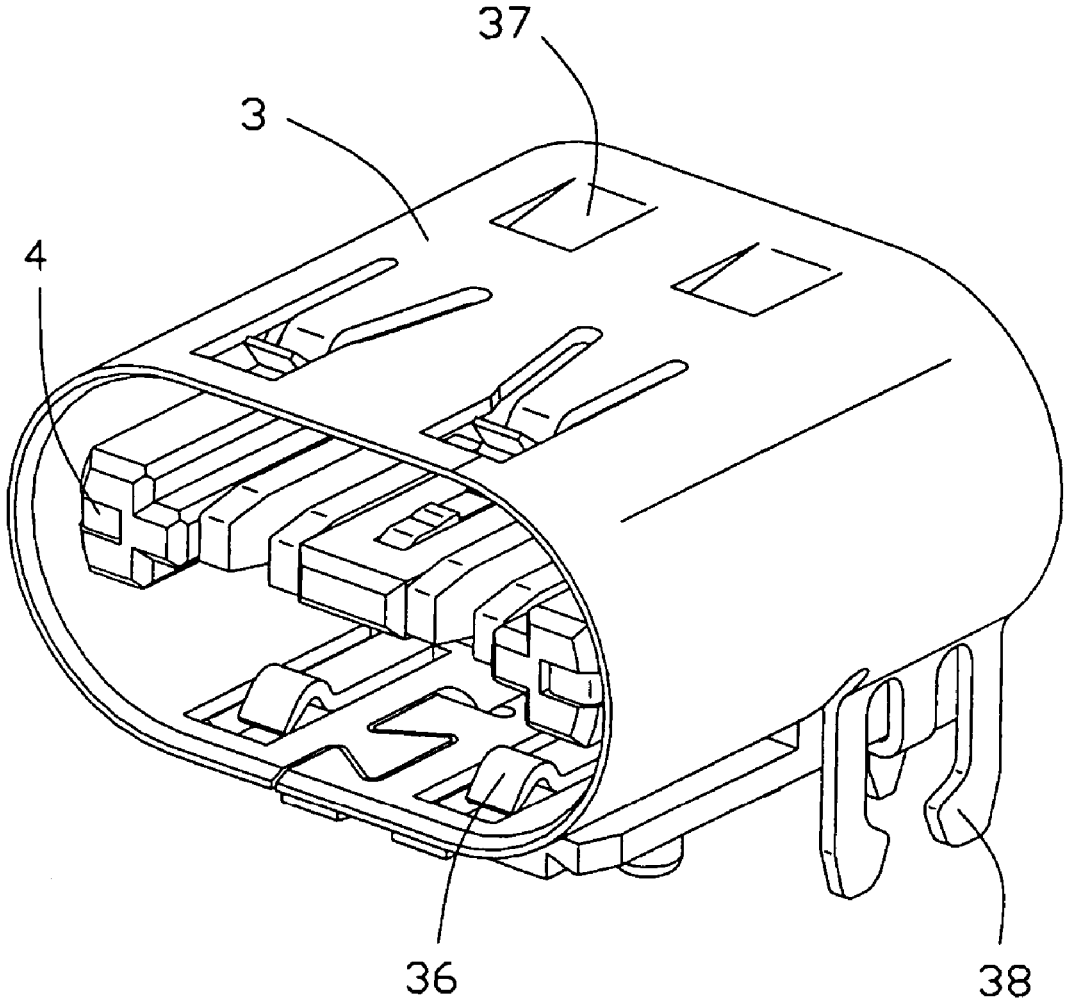
FIG. 3 is a perspective view of the electrical connector in accordance with the present invention.
Figure 4:
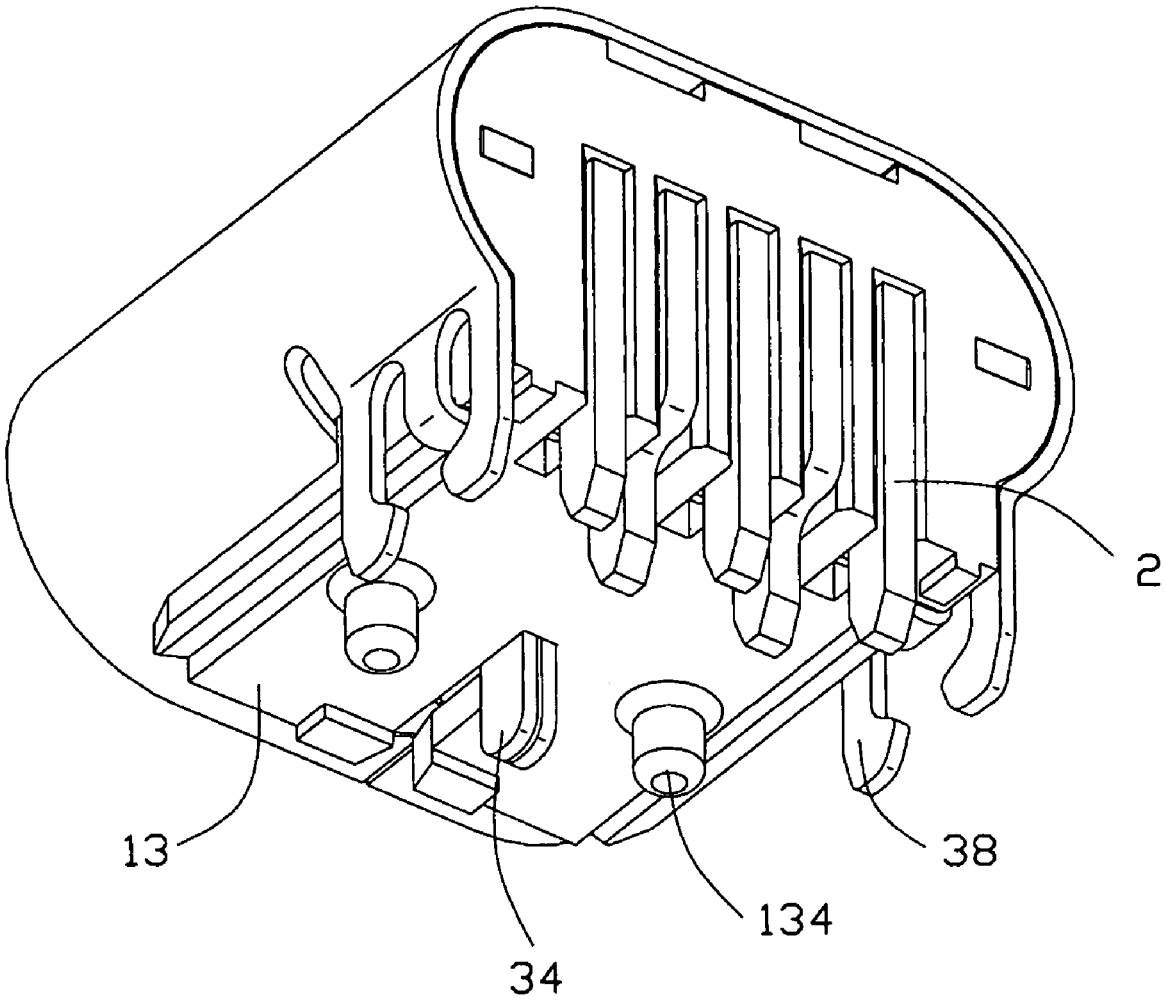
FIG. 4 is a view similar to FIG. 4, but taken from a different perspective.

Referring to FIGS. 3–4, the shell 3 is assembled to the insulative housing 1. The insulative housing 1 is inserted into the frame 31 from the rear of the shell 3, with the positioning leg 34 abutting against an end of the channel 135 defined on the insulative housing 1. Then the two spring tabs 37 on the shell 3 abut against corresponding cutouts 106 defined on the base portion 10, the two curved beams 36 on the lower surface 36 of the shell 3 are located above corresponding depression portions 133 of the mounting portion 13, and the latching legs 39 clamp with corresponding latching grooves 136. The positioning post 134 is mounted to the PCB, and the positioning legs 34 and the mounting legs 38 are soldered to the PCB.

The complete configuration of this electrical connector is shown in FIG. 3 and FIG. 4. When the complementary connector is inserted, each curved beam 36 of the shell 3 having a distal end bent inwardly into the receiving space 31 imposes a clamping force to retain the complementary connector in the electrical connector.

The electrical connector of this invention forms ribs 11 at the side of the terminals 2. And the ribs 11 are provided in the interior of the base portion 10, which would not enlarge the size of the connector. The ribs 11 can be configured as other shapes, while each rib 11 has a pair of opposite surfaces protruding beyond the conductive surfaces of the terminals 2, and it is provided longer than the terminals 2 extending from the front face 101. Each of the terminals 2 has two conductive surface exposed in the air, which is good for radiating the heat resulting from the transmitting of the electrical signals. The tongue portion 12 of this connector is approximately plate-like, so it is convenient for manufacture.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing comprising a base portion and a terminal supporting portion extending forwardly from the base portion;

a plurality of passageways for receiving a plurality of terminals retained in the insulative housing and each terminal having a contact portion extending along the terminal supporting portion;

a shell attached to the insulative housing and having a mating frame surrounding the contact portions and the terminal supporting portion to define a mating cavity therebetween; and a pair of strengthened members different from the terminals in configuration buried at opposite ends of the terminal supporting portion; wherein the strengthened members are made of high-intensity material and each comprises a retaining portion and a strengthening portion; wherein the terminal supporting portion comprises two ribs at two longitudinal ends thereof, wherein each rib has two protrusions respectively projecting upwardly and downwardly along a vertical direction, and wherein each protrusion has a horizontal wall to define a channel therebetween; and wherein the each strengthened member is inserted to the channel, wherein the channel different from each of the passageways in configuration.

2. The electrical connector as described in claim 1, wherein the terminals extend to divide the terminal supporting portion into several parts, and wherein two middle parts are linked with a beam at free ends thereof to sandwich corresponding terminal therebetween.

3. The electrical connector as described in claim 2, wherein the terminals are arranged in one row, and wherein two side terminals extends with the ribs side by side.

4. The electrical connector as described in claim 3, wherein a part of terminal supporting portion between each side terminal and its neighboring one is cut-off absolutely from the base portion.

5. The electrical connector as described in claim 1, wherein a mounting portion is provided lower than and connecting to the base portion, and the mounting portion extends parallel with the terminal supporting portion.

6. The electrical connector as described in claim 5, wherein the shell comprises an upper wall and a lower wall, each defines two curved beams thereon.

7. The electrical connector as described in claim 1, wherein the shell is of elliptic cross-section surrounding the insulative housing.

8. An electrical connector comprising:

an insulative housing defining a base with a plurality of ribs extending forward therefrom, and an area between the ribs been cut off absolutely from the base portion to define an empty space;

a plurality of passageways for receiving a plurality of contacts disposed in the base with contacting portions of the contacts extend forwardly beyond the base and located between the ribs; and a metallic shield attached to the housing and including a mating frame receiving the ribs and the contact portions; wherein a metallic or hard polymeric strengthened member different from the contacts in configuration and embedded within a corresponding rib for reinforcement of the rib; wherein the strengthened member is made of high-intensity material and comprises a retaining portion and a strengthening portion; wherein the rib is located at an outmost position of the plurality of ribs and has two protrusions respectively projecting upwardly and downwardly along a vertical direction, and wherein each protrusion has a horizontal wall to define a channel therebetween; and wherein the strengthened member is inserted to the channel, wherein the channel different from each of the passageways in configuration.

9. The electrical connector as claimed in claim 8, wherein said strengthened member is transversely exposed to the mating frame.

10. The electrical connector as claimed in claim 9, wherein said strengthened member does not directly transversely contact said mating frame.

11. The electrical connector as claimed in claim 8, wherein each of said contacts extends in a vertical plane while said strengthened member extends in a horizontal plane.

12. The electrical connector as claimed in claim 8, wherein said rib defines a mountain-like cross-sectional configuration with the channel to receive the corresponding strengthened member therein.

13. An electrical connector comprising:

an insulative housing defining a base with a tongue portion extending forward therefrom;

a plurality of passageways for receiving a plurality of contacts disposed in the base with contacting portions of the contacts extend forwardly beyond the base and located at a same level with the tongue portion; and a metallic shield attached to the housing and including a mating frame enclosing the tongue portion and the contact portions; wherein a metallic or hard polymeric strengthened member different from the contacts in configuration embedded within the tongue portion for reinforcement of the tongue portion; wherein the strengthened member is made of high-intensity material and comprises a retaining portion and a strengthening portion; wherein the tongue portion is located at an outmost position of the base and has two protrusions respectively projecting upwardly and downwardly along a vertical direction, and wherein each protrusion has a horizontal wall to define a channel therebetween; and wherein the strengthened member is inserted to the channel, wherein the channel different from each of the passageways in configuration.

14. The electrical connector as claimed in claim 13, wherein said mating frame defines a capsular cross-sectional configuration, and the strengthened member is located adjacent to one of two opposite distal ends of said capsular cross-sectional configuration.

15. The electrical connector as claimed in claim 14, wherein said strengthened member transversely communicates with but not engages the mating frame.

* * * * *